US009677330B2

(12) United States Patent
Anderson et al.

(10) Patent No.: US 9,677,330 B2
(45) Date of Patent: Jun. 13, 2017

(54) ARRANGEMENT FOR A COMPONENT HOUSING FOR USE IN A RAIL OF A WINDOW COVERING

(71) Applicant: Hunter Douglas Inc., Pearl River, NY (US)

(72) Inventors: Richard N Anderson, Whitesville, KY (US); Eugene W Thompson, Maceo, KY (US); Robert E Fisher, II, Owensboro, KY (US)

(73) Assignee: Hunter Douglas Inc., Pearl River, NY (US)

( * ) Notice: Subject to any disclaimer, the term of this patent is extended or adjusted under 35 U.S.C. 154(b) by 87 days.

(21) Appl. No.: 14/663,600

(22) Filed: Mar. 20, 2015

(65) Prior Publication Data

US 2015/0197984 A1 Jul. 16, 2015

Related U.S. Application Data

(63) Continuation-in-part of application No. 14/326,616, filed on Jul. 9, 2014, now Pat. No. 9,422,766.

(60) Provisional application No. 61/873,035, filed on Sep. 3, 2013, provisional application No. 61/847,117, filed on Jul. 17, 2013.

(51) Int. Cl.

| | |
|---|---|
| ***E06B 9/56*** | (2006.01) |
| ***E06B 9/322*** | (2006.01) |
| ***E06B 9/325*** | (2006.01) |
| *E06B 9/262* | (2006.01) |

(52) U.S. Cl.

CPC ..... *E06B 9/322* (2013.01); *E06B 9/262* (2013.01); *E06B 9/325* (2013.01); *E06B 2009/2625* (2013.01); *E06B 2009/3222* (2013.01)

(58) Field of Classification Search

CPC . E06B 9/30; E06B 9/303; E06B 9/322; E06B 2009/3222; E06B 9/262; E06B 2009/2625; E06B 2009/2627; E06B 9/324; E06B 9/325

USPC ... 160/84.01–84.06, 298, 178.2, 170, 172 R, 160/173 R, 174 R, 176.1 R, 177 R, 160/178.1 R

See application file for complete search history.

(56) References Cited

U.S. PATENT DOCUMENTS

| | | | | | |
|---|---|---|---|---|---|
| 4,887,657 | A * | 12/1989 | Spohr | E06B 9/365 | 160/173 R |
| 5,267,598 | A * | 12/1993 | Marocco | E06B 9/307 | 160/176.1 R |
| 5,647,422 | A * | 7/1997 | Weng | E06B 9/364 | 160/176.1 V |
| 5,957,184 | A * | 9/1999 | Gross | E06B 9/322 | 160/177 R |
| 6,029,734 | A * | 2/2000 | Wang | E06B 9/322 | 160/170 |

(Continued)

FOREIGN PATENT DOCUMENTS

| | | |
|---|---|---|
| EP | 2740878 | 6/2014 |
| EP | 2826944 | 1/2015 |
| WO | WO 2013/129918 | 9/2013 |

*Primary Examiner* — Katherine Mitchell
*Assistant Examiner* — Johnnie A Shablack
(74) *Attorney, Agent, or Firm* — Dority & Manning, P.A.

(57) ABSTRACT

The base and cover of a component housing are releasably assembled to each other with yokes on one of said base and cover, with at least one of said yokes flexing to slide over and snap around a respective boss on the other of said yoke and cover.

12 Claims, 6 Drawing Sheets

(56) References Cited

U.S. PATENT DOCUMENTS 6,575,223 B1 * 6/2003 Chung ..... E06B 9/32 160/170
7,093,644 B2 * 8/2006 Strand ..... E06B 9/322 160/170
7,096,917 B2 * 8/2006 Ciuca ..... E06B 9/322 160/170
7,159,635 B2 * 1/2007 Holt ..... E06B 9/322 160/170
7,180,398 B2 * 2/2007 Hoffmann ..... H01F 5/02 336/198
7,311,133 B2 * 12/2007 Anderson ..... E06B 9/262 160/170
7,913,738 B2 * 3/2011 Fraser ..... E06B 9/322 160/115
8,770,257 B2 * 7/2014 Kao ..... E06B 9/322 160/174 R
9,078,537 B2 * 7/2015 Lee ..... A47H 5/032
9,217,282 B2 * 12/2015 Defenbaugh ..... E06B 9/68
9,314,125 B2 * 4/2016 Anthony ..... A47H 5/032
9,357,868 B2 * 6/2016 Anderson ..... E06B 9/322
2007/0051477 A1 * 3/2007 Fraser ..... E06B 9/262 160/84.05
2013/0340949 A1 * 12/2013 Anderson ..... E06B 9/262 160/84.02
2014/0076504 A1 * 3/2014 Anthony ..... A47H 5/032 160/84.04
2015/0020982 A1 * 1/2015 Anderson ..... E06B 9/324 160/298
2015/0028144 A1 * 1/2015 Defenbaugh ..... E06B 9/322 242/378.4
2015/0075729 A1 * 3/2015 Anderson ..... E06B 9/262 160/193
2015/0197984 A1 * 7/2015 Anderson ..... E06B 9/322 160/298
2015/0211293 A1 * 7/2015 Anderson ..... E06B 9/262 160/170
2016/0010389 A1 * 1/2016 Anderson ..... E06B 9/322 188/65.1
2016/0017656 A1 * 1/2016 Adreon ..... E06B 9/322 160/7
2016/0222722 A1 * 8/2016 Schulman ..... E06B 9/322

* cited by examiner

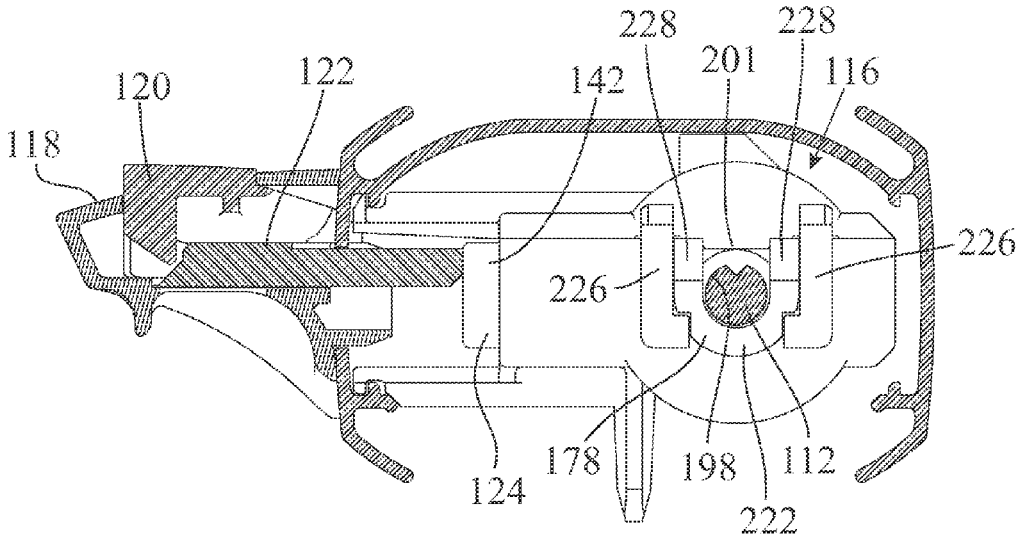
FIG 3
FIG 4
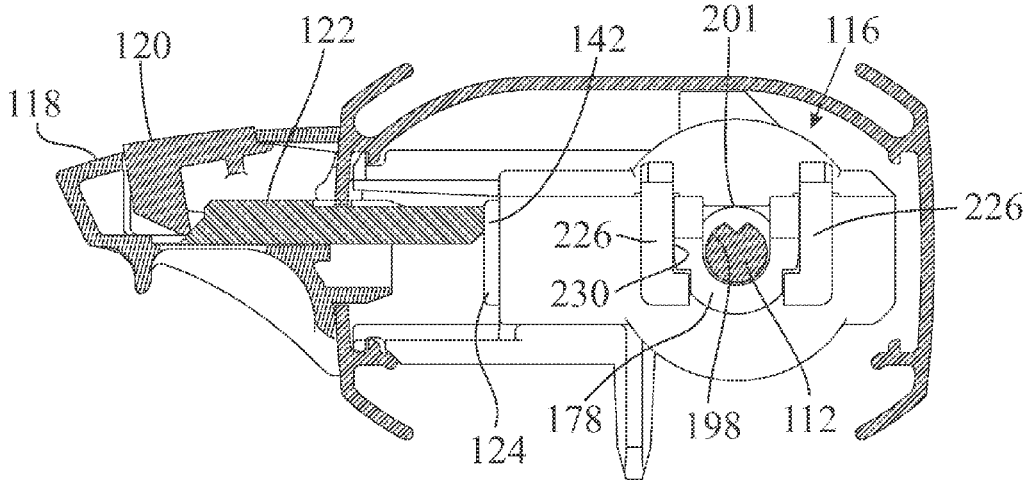

ARRANGEMENT FOR A COMPONENT HOUSING FOR USE IN A RAIL OF A WINDOW COVERING

This application is a continuation-in-part of U.S. patent application Ser. No. 14/326,616, filed Jul. 9, 2014, which claims priority from U.S. Application Ser. No. 61/873,035 filed Sep. 3, 2013 and from U.S. Application Ser. No. 61/847,117 filed Jul. 17, 2013.

BACKGROUND

The present invention relates to an arrangement for a component housing having a base and a cover for use in a rail of a window covering.

SUMMARY

The present invention provides a simple, secure, inexpensive, and fast arrangement for releasably securing a cover to a base of a component for use in a rail of a window covering.

BRIEF DESCRIPTION OF THE DRAWINGS

FIG. 3 is a section view along line 3-3 of FIG. 1, with the cellular shade product omitted for clarity;

FIG. 4 is a section view, similar to FIG. 3, but with the brake release mechanism depressed to release the brake;

DESCRIPTION

Figure 1:
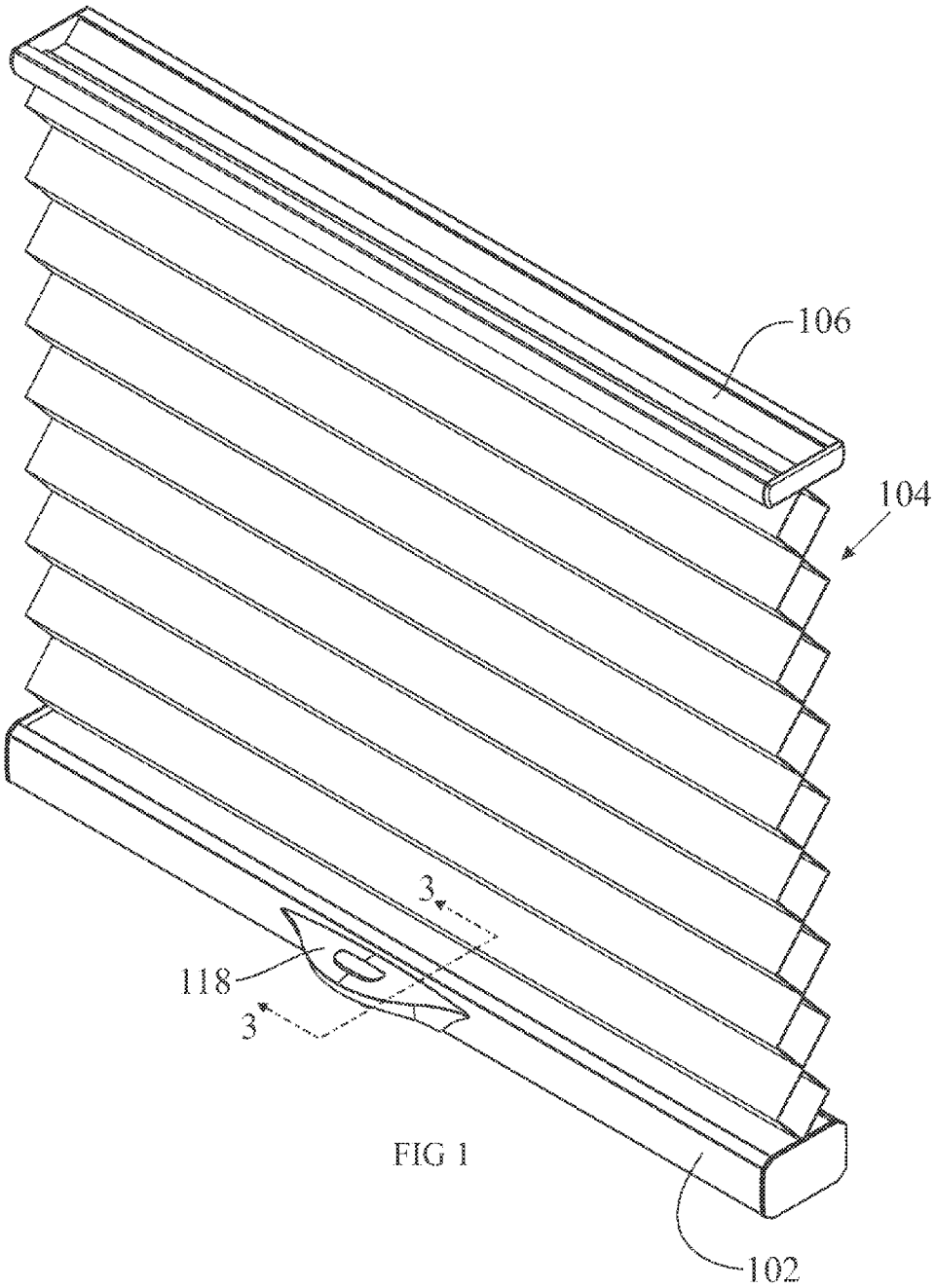
FIG. 1 is a perspective view of a cellular shade product with a handle secured to the movable rail.

FIG. 1 is a perspective view of a cellular shade 104, having an upper rail 106, a movable lower rail 102, and a handle 118 mounted on the lower rail 102. As will be explained later, the handle 118 also may be mounted on the upper rail 106 or on any intermediate movable rails (not shown).

Figure 2:
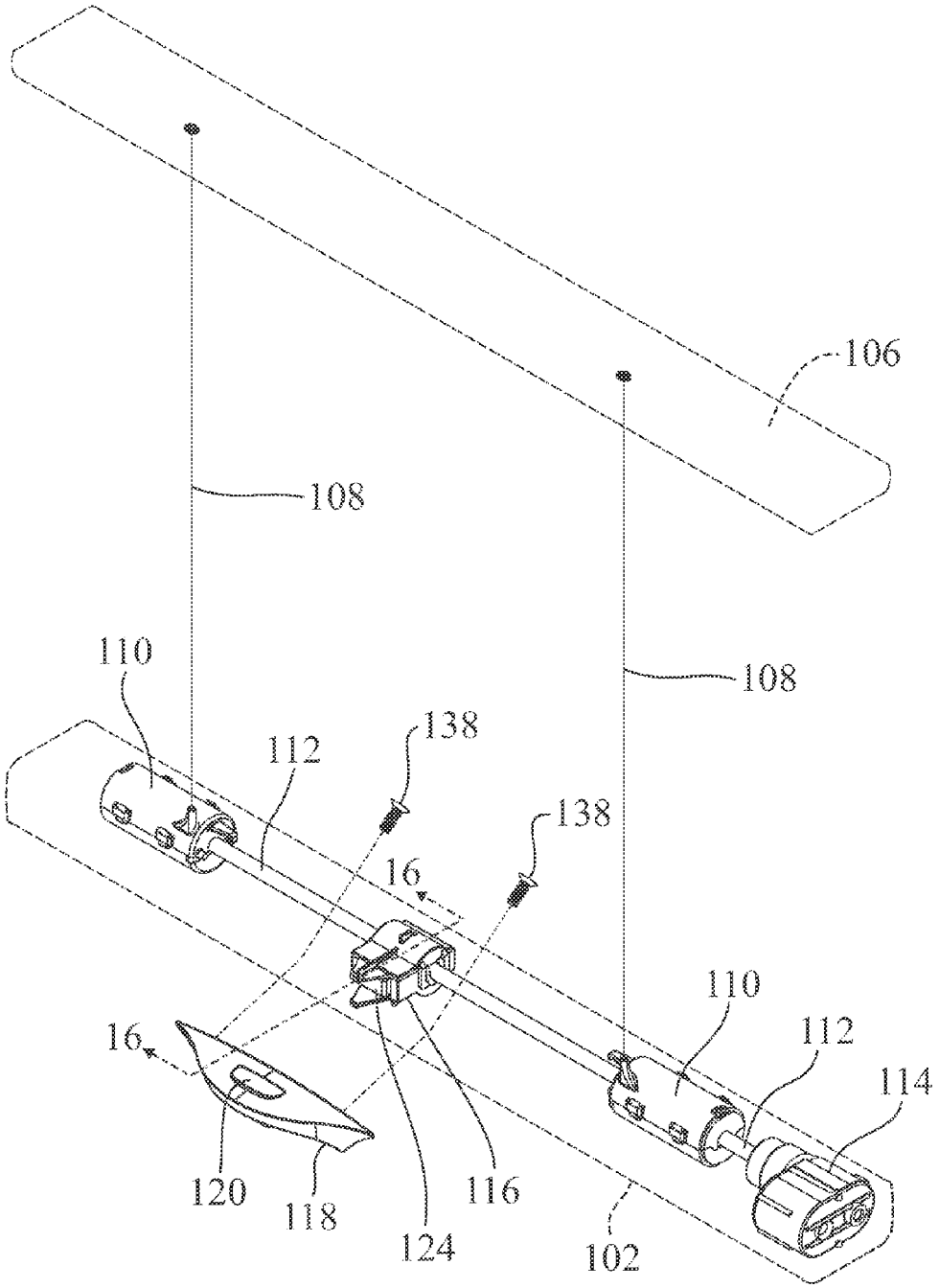
FIG. 2 is a schematic, partially exploded, perspective view of the drive mechanism of FIG. 1 including the handle and a brake.

FIG. 2 is a schematic showing the rails 102, 106 in phantom, with the cellular shade itself omitted for clarity. The lower rail 102 is suspended from the upper rail 106 by means of left and right lift cords 108 which wind onto lift spools (not shown) in lift stations 110 (when raising the shade 104), or unwind from the spools of the lift stations 110 (when lowering the shade 104). The lift stations 110 are functionally interconnected by an elongated lift rod 112 that extends in the elongated direction of the rail, such that the lift rod 112 and lift spools of the lift stations 110 rotate in unison. The lift rod 112 extends through the rightmost lift station 110 and is connected to a spring motor 114 which provides a force to aid the user in lifting the shade 104. As the rod 112 rotates in one direction about its axis of rotation, the lift cords 108 wind up onto the lift spools of the lift stations 110 to retract the shade, and as the rod 112 rotates in the opposite direction, the lift cords 108 unwind from the lift spools and extend the shade or covering 104.

In this embodiment, the spring motor 114 is underpowered such that it is unable to raise the shade 104 alone and needs additional input (referred to as a catalytic force) from the user to accomplish that task. This particular spring motor 114 also is unable to hold the bottom rail 102 in place once it is released by the user. The weight of the bottom rail 102 (together with the components found in the bottom rail 102 and the weight of the shade material) overwhelms the force provided by the spring motor 114 such that the bottom rail 102 will continue to drop once released by the user unless it is stopped by other means. To stop the bottom rail from dropping, a brake 116 is functionally connected to the lift rod 112 and to the bottom rail 102 to stop the lift rod 112 from rotating in at least one direction relative to the bottom rail 102, as explained in more detail later.

The handle 118 includes an actuator button 120 which, when depressed by the user, releases the brake 116, which allows rotation of the lift rod 112 in both clockwise and counterclockwise directions, as explained in more detail later. The handle 118 is secured to the rail 102 using screws 138.

The brake 116 can be mounted anywhere along the lift rod 112 and does not have to be precisely located relative to the handle 118 in order for the actuator button 120 to function to release the brake 116. This is advantageous, as it permits the handle to be secured to the rail 102 from inside the rail with the brake 116 out of the way, and then permits the brake 116 to be slid along the lift rod 112 into a position that is generally opposite the handle 118, without having to worry about the precise location of the brake 116.

Figure 5:
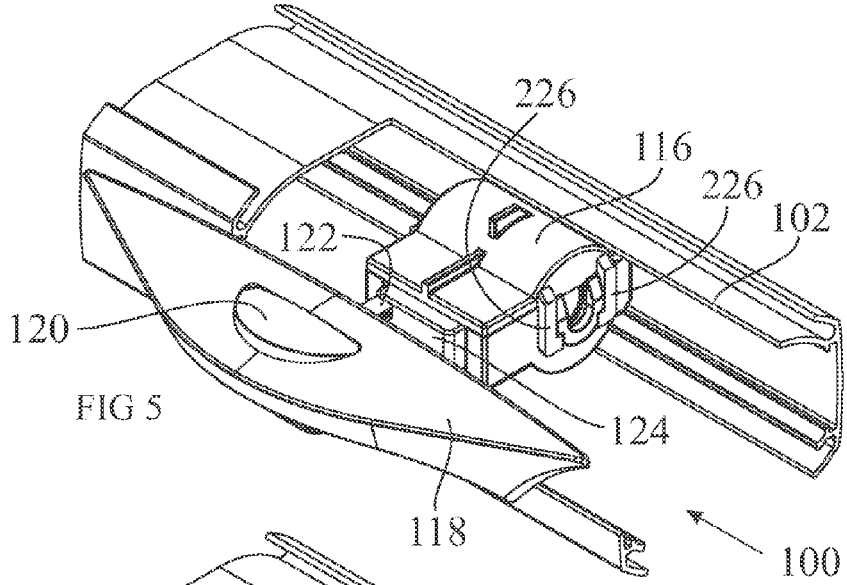
FIGS. 5-7 show the handle and brake mechanism of FIG. 3 with the lift rod omitted for clarity, and with the brake portion in three different axial positions relative to the handle portion to illustrate that the brake portion does not have to be precisely located in order for the pusher to actuate the brake release mechanism.
Figure 6:
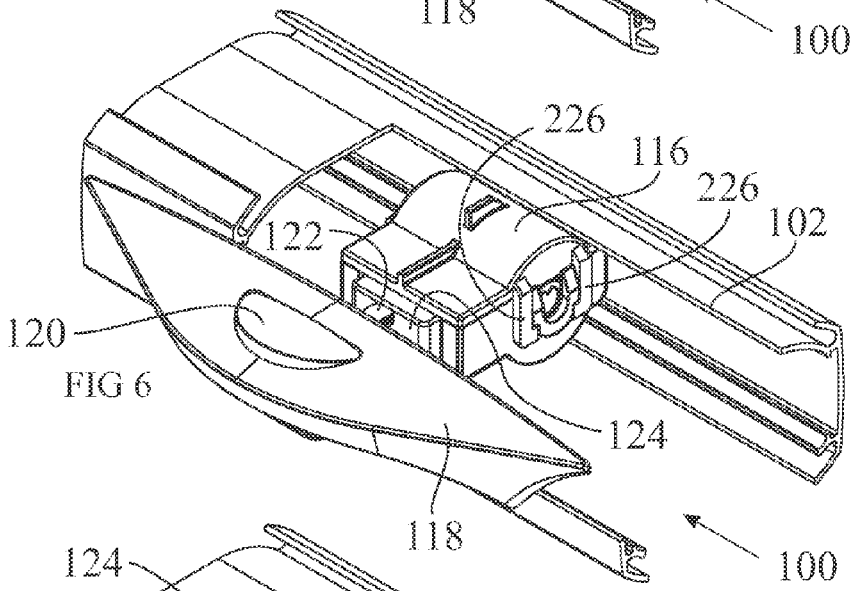
Figure 7:
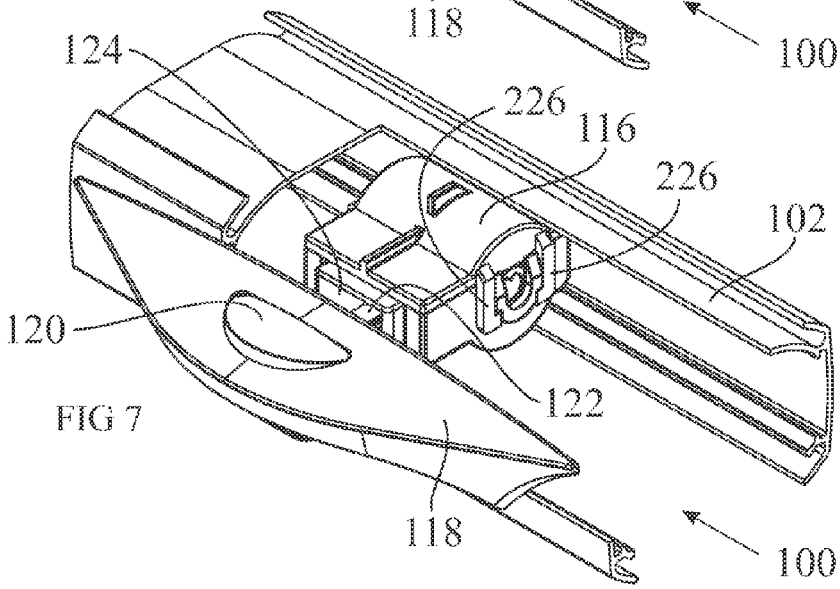

As shown in FIGS. 5-7, the brake 116 may be anywhere along the axial length of the rail 102 as long as it is aligned approximately in the vicinity of the pusher 122, which in this embodiment is a shaft. As long as the pusher 122 abuts the contact plate 124 of the brake 116, the handle and brake combination 100 will operate as designed.

Figures 8, 9:
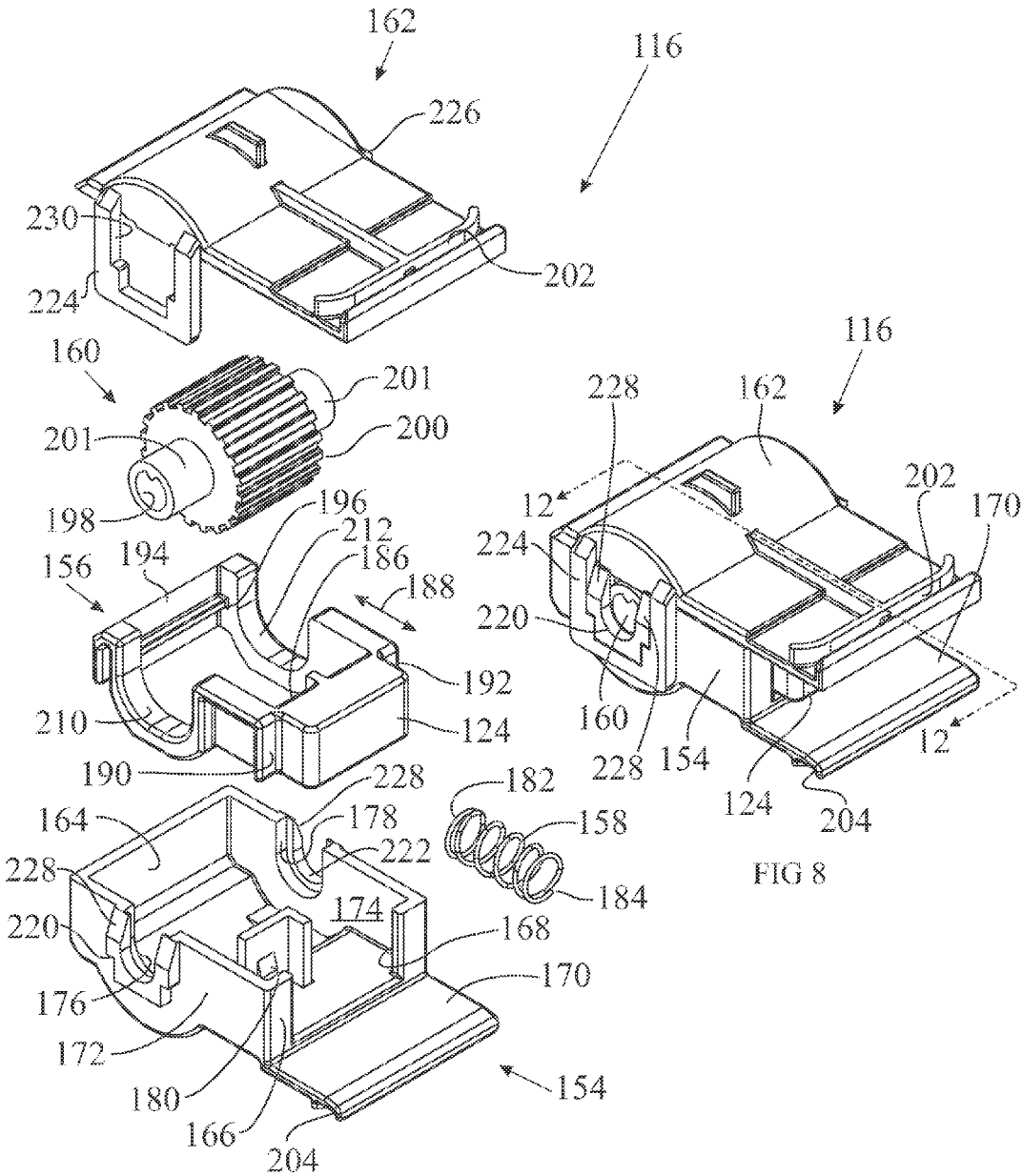
FIG. 8 is a perspective view of the brake portion of the brake and handle mechanism of FIG. 7.
FIG. 9 is an exploded perspective view of the brake portion of FIG. 8.

FIG. 9 shows the details of the brake 116. The brake 116 includes a housing base 154, a slide element 156, a coil spring 158, a splined sleeve 160 and a housing cover 162. The housing base 154 is a substantially rectangular box having a flat back wall 164, a flat front wall 166 which defines a large central opening 168, and a forwardly extending fixed tab 170 secured to the front wall 166 for mounting the housing base 154 on the rail 102. The housing base 154 includes side walls 172, 174, which define aligned, "U"-shaped openings 176, 178 which provide bearing surfaces to rotationally support the splined sleeve 160. The housing base 154 also defines an internal projection 180 designed to receive and engage one end 182 of the coil spring 158. The other end 184 of the coil spring 158 is received in a partitioned cavity 186 on the slide element 156, in order to bias the slide element 156 in the forward (braking) direction, which is transverse to the axis of rotation of the lift rod 112, as will be described in more detail later.

The slide element 156 has a contact plate 124, which is pushed against by the actuator in the handle 118, in a direction opposite to the braking direction, in order to disengage the brake. The slide element 156 is received in the housing base 154, with the contact plate 124 of the slide element 156 projecting through the opening 168 in the housing 154. The slide element 156 is guided by the housing base 154 so its movement is restricted to forward and backward movement in the direction of the arrow 188 relative to the housing base 154. Shoulders 190, 192 on the slide element 156 limit the movement of the slide element 156 in the forward direction as they impact the front wall 166 of the housing 154. As indicated above, the coil spring 158 biases the slide element 156 in the forward direction (which as explained later, is the braked position). The rear wall 194 of the slide element 156 defines a left-to-right directed ridge 196, which extends parallel to the front and rear walls 124, 194 of the slide element 156 and parallel to the lift rod 112.

The splined sleeve 160 is a generally cylindrical body defining a hollow through shaft 198 having a non-circular profile. In this particular embodiment, the hollow through shaft 198 has a "V" projection profile. The lift rod 112 (See FIG. 2) has a complementary "V" notch. The lift rod 112 is sized to match the internal profile of the hollow through shaft 198, with the "V" projection of the hollow through shaft 198 being received in the "V" notch of the lift rod 112, such that the splined sleeve 160 and the lift rod 112 are positively engaged to rotate together. Thus, when the splined sleeve 160 is prevented from rotation, the lift rod 112 is likewise prevented from rotation.

The splined sleeve 160 also defines a plurality of radially extending splines 200. The ends of the splined sleeve 160 define smooth stub shafts 201 which are rotationally supported on the "U"-shaped bearing surfaces 176, 178 of the housing base 154. The slide element 156 has recessed arms 210, 212, which permit the slide element 156 to move forwardly and backwardly within the housing base 154 without interfering with the stub shafts 201.

Figure 10:
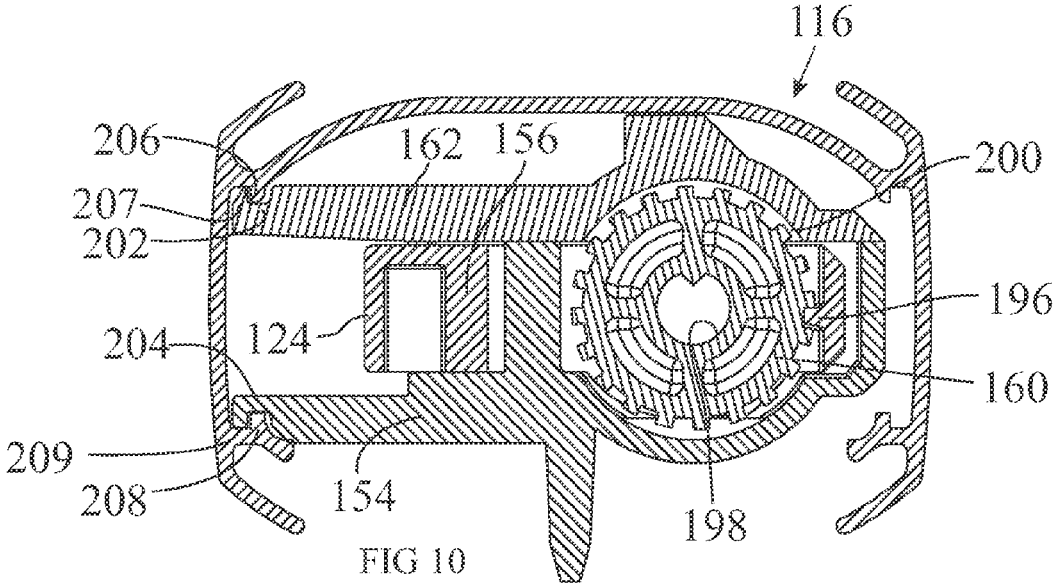
FIG. 10 is a section view through the brake and rail, showing how the brake component mounts on the rail.

As shown in FIG. 10, when the slide element 156 is pushed forward by the biasing spring 158, which is its normal, braked position, the ridge 196 on the rear wall 194 of the slide element 156 is received between two of the splines 200 of the splined sleeve 160, which prevents rotation of the splined sleeve 160 and of the lift rod 112 (and of the lift drums in the lift stations 110), thereby preventing the movable rail 102 from being raised or lowered.

When the slide element 156 is pushed rearwardly by pushing against the contact plate 124, the ridge 196 moves out of engagement with the splined sleeve 160, allowing the splined sleeve 160, the lift rod 112, and the lift drums to rotate in order to raise or lower the movable rail 102.

A housing cover 162 snaps onto the housing base 154 to substantially enclose the slide element 156 and the coil spring 158, as well as the splined sleeve 160 within the housing of the brake 116. As shown in FIG. 10, a channel 202 on the housing cover 162 and a corresponding channel 204 on the housing base 154 receive corresponding lips 206, 208 on the rail 102, and ribs 207, 209 on the housing cover 162 and housing base 154 engage the lips 206, 208 on the rail 102 (See FIG. 10) to mount the brake 116 onto the rail 102. This mounting arrangement for the cover 162 and base 154 of the brake 116 firmly secures the body of the brake 116 to the front wall 13 of the rail 102 while allowing the brake 116 to slide in the longitudinal direction along the rail 102.

Referring now to FIG. 9, the base 154 defines bosses 220, 222 on the outer surfaces of the opposite side walls 172, 174. The upper portion of each boss 220, 222 defines ramped surfaces 228 to help the cantilevered yokes 224, 226 on the opposite ends of the cover 162 slide over the bosses 220, 222 and snap over the bosses 220, 222, as described in more detail later. The cantilevered yokes 224, 226 on the cover 162 define an internal opening 230, for receiving the respective boss 220, 222, with the sides and bottom portions of the cantilevered yokes 224, 226 contacting the sides and bottom of the respective boss 220, 222.

It will be noted that the cantilevered yokes 224 on the left end of the cover 116 (shown in FIGS. 8 and 9) are slightly different from the cantilevered yokes 226 on the right end of the cover 116 (shown in FIGS. 3-7), with the cantilevered yokes 224 on the left end of the cover 116 being connected together at the bottom to form a U-shape that wraps completely around the bottom of the boss 220, and the cantilevered yokes 226 on the right end of the cover 116 being made of separate legs that only partially wrap around the bottom of the boss 222. It would alternatively be possible for both of the cantilevered yokes 224, 226 to be identical to each other, either both yokes being U-shaped, with their legs connected together to form the "U", or both having separate legs, with each leg being "J"-shaped to wrap partially around the bottom of their respective boss.

FIG. 9 shows the cantilevered yokes 224, 226 projecting downwardly from each end of the cover 162. These cantilevered yokes 224, 226 are sized and located such that they receive their corresponding boss 220, 222 when the cover 162 is assembled onto the base 154, as best shown in FIGS. 8 and 9. As the cover 162 is pushed down onto the base 154, the yokes 224, 226 ride along the ramped surfaces 228 on the upper portion of the bosses 220, 222, which cause the yokes 224, 226 to flex outwardly so the yokes can pass over the bosses 220, 222. Once the yokes 224, 226 clear their respective bosses 220, 222, the yokes 224, 226 snap back to their at-rest rest condition, wrapping around and snugly receiving their respective bosses 220, 222 in the openings 230.

Referring briefly to FIG. 2, it may be appreciated that the lift rod 112 extends through the brake component 116, extending through the openings 230 in the yokes 224, 226 on the housing cover 116, and through the arcuate openings 176, 178 in the housing base 154. The rod 112 extends through the openings 230 defined by the cantilevered yokes 224, 226, through the U-shaped openings 176, 178 in the base 154, and through the hollow shaft 198 in the rotating element that is supported on the housing, which, in this case, is the splined sleeve 160, which is housed in the component housing.

It will be understood by those skilled in the art that other components mounted on the rail, in addition to the brake component 116, could also have a housing with a similar yoke-and-boss arrangement, in which the elongated rod 112 would extend through, and possibly rotate with, a rotating component, such as the splined shaft 160. Furthermore, the cantilevered yoke portion may be on the cover or on the base, and the boss portion may also be on the cover or the base. It also should be noted that a ramped surface could be on the lower portion of the inner surface of the yoke 224, 226 instead of or in addition to being on the upper portion of the outer surface of the boss 220, 222.

Assembly:

Referring to FIG. 9, to assemble the brake portion 116, the front end 184 of the coil spring 158 is placed inside the cavity 186 of the slide element 156 lying just inside the contact plate 124. The slide element 156 then is slid into the housing 154, with the contact plate 124 projecting through the front opening 168. The back end 182 of the coil spring 158 then is slid over the internal projection 180 on the housing base 154 so as to capture the coil spring 158, with the coil spring 158 biasing the slide element 156 in the forward, braked position. The splined sleeve 160 is dropped in between the recessed arms 210, 212 of the slide element 156 such that the stub shafts 201 of the splined sleeve 160 are rotationally supported on the "U"-shaped bearing surfaces 176, 178 of the housing base 154 and the ridge 196 is received between two of the splines 200. Finally, the housing cover 162 is snapped onto the housing base 54.

The assembled brake 116 is then mounted into the rail 102 (See FIG. 10) by sliding it in from one of the ends of the rail 102, making sure that the upper and lower channels 202, 204 of the brake portion 116 are engaged with the lips 206, 208 of the rail 102. The brake 116 is slid axially along the rail 102 (See FIG. 2) until at least a portion of the contact plate 124 of the brake portion 116 is in alignment with the blunt distal end 142 of the actuator arm 122 of the handle 118 (See FIGS. 7-9). Finally the lift rod 112 is inserted through the hollow through shaft 198 of the splined sleeve 160 and the remaining elements, such as the lift stations 110 and the spring motor 114 are mounted onto the lift rod 112.

It will be obvious to those skilled in the art that modifications may be made to the embodiments described above without departing from the scope of the present invention as claimed.

What is claimed is:

1. An arrangement for a component for use on a rail of a window covering, comprising:

a component housing, comprising a cover and a base, one of said cover or said base including a first end wall and a second end wall opposite said first end wall;

an elongated rod defining an axis of rotation, said elongated rod configured to extend through said component housing along said axis of rotation;

a first boss projecting outwardly from said first end wall;

a second boss projecting outwardly from said second end wall;

first and second opposed cantilevered yokes projecting from the other of said cover or said base, said first cantilevered yoke defining a first opening and being configured to engage said first boss when said cover is installed relative to said base, said second cantilevered yoke defining a second opening and being configured to engage said second boss when said cover is installed relative to said base;

wherein:

at least one of said first boss or said first cantilevered yoke defines a ramped surface;

when said cover and said base are brought together, said first cantilevered yoke flexes outwardly away from an interior of said component housing in a direction parallel to said axis of rotation due to said ramped surface such that said first cantilevered yoke rides along an exterior of said first boss and then snaps back towards said interior of said component housing to receive said first boss in said first opening of said first cantilevered yoke; and when said cover and said base are brought together, said second cantilevered yoke receives said second boss.

2. The arrangement for a component as recited in claim 1, wherein an elongated channel on one of said housing or a rail of a window covering receives a corresponding elongated lip on the other of said housing or the rail to slidably mount said housing on the rail so that said housing can slide axially along said elongated rod relative to the rail.

3. The arrangement for a component as recited in claim 1, wherein at least one of said first cantilevered yoke or said second cantilevered yoke is U-shaped and wraps completely around the respective boss when said cover is installed relative to said base.

4. The arrangement for a component as recited in claim 1, wherein:

at least one of said first cantilevered yoke or said second cantilevered yoke includes first and second legs; and said first and second legs are only configured to partially wrap around the respective boss when said cover is installed relative to said base.

5. The arrangement for a component as recited in claim 1, wherein said elongated rod extends through said first and second openings defined in said first and second cantilevered yokes along said axis of rotation.

6. The arrangement for a component as recited in claim 5, and further comprising a rotating element mounted on said elongated rod for rotation with said elongated rod, said rotating element being housed within said component housing.

7. The arrangement for a component as recited in claim 6, wherein:

said first end wall defines a first U-shaped opening;

said second end wall defines a second U-shaped opening; and said first and second U-shaped openings supporting said rotating element within said component housing.

8. The arrangement for a component as recited in claim 6, wherein said rotating element is a splined sleeve.

9. The arrangement for a component as recited in claim 6, wherein at least one of said base or said cover defines bearing surfaces which support said rotating element.

10. The arrangement for a component as recited in claim 9, wherein said elongated rod extends through both of said first and second openings in said first and second cantilevered yokes.

11. The arrangement for a component as recited in claim 10, wherein at least one of said first cantilevered yoke or said second cantilevered yoke is U-shaped and wraps completely around the respective boss when said cover is installed relative to said base.

12. The arrangement for a component as recited in claim 10, wherein:

at least one of said first cantilevered yoke or said second cantilevered yoke includes first and second legs; and said first and second legs are only configured to partially wrap around the respective boss when said cover is installed relative to said base.

* * * * *